US010994330B2

(12) United States Patent
Werner et al.

(10) Patent No.: US 10,994,330 B2
(45) Date of Patent: May 4, 2021

(54) DEVICE, CONTROL SYSTEM AND FILTER MODULE FOR PRODUCING DIE-CAST PARTS, AND METHOD THEREFOR

(71) Applicant: MAGNA BDW TECHNOLOGIES GMBH, Markt Schwaben (DE)

(72) Inventors: Christian Werner, Forstern (DE); Armin Dugum, Munich (DE)

(73) Assignee: MAGNA BDW TECHNOLOGIES GMBH, Markt Schwaben (DE)

( * ) Notice: Subject to any disclaimer, the term of this patent is extended or adjusted under 35 U.S.C. 154(b) by 0 days.

(21) Appl. No.: 16/399,722

(22) Filed: Apr. 30, 2019

(65) Prior Publication Data

US 2019/0255604 A1 Aug. 22, 2019

Related U.S. Application Data

(63) Continuation of application No. PCT/EP2017/076860, filed on Oct. 20, 2017.

(30) Foreign Application Priority Data

Nov. 4, 2016 (DE) ..... 10 2016 221 674.0
Nov. 4, 2016 (DE) ..... 10 2016 221 675.9
Nov. 4, 2016 (DE) ..... 10 2016 221 678.3

(51) Int. Cl.
*B22D 17/14* (2006.01)
*B22D 17/22* (2006.01)
*B22D 17/32* (2006.01)

(52) U.S. Cl.
CPC ..... *B22D 17/145* (2013.01); *B22D 17/22* (2013.01); *B22D 17/32* (2013.01)

(58) Field of Classification Search
CPC ..... B22D 17/14; B22D 17/145; B22D 17/22; B22D 17/32
USPC ..... 164/305, 410, 358, 134
See application file for complete search history.

(56) References Cited

U.S. PATENT DOCUMENTS 3,349,833 A 10/1967 Hodler
4,463,793 A 8/1984 Thurner
2003/0041993 A1 3/2003 Kuramasu et al.
2003/0056931 A1 3/2003 Wuthrich
(Continued)

FOREIGN PATENT DOCUMENTS

CN 1409036 A 4/2003
CN 2617500 Y 5/2004
CN 201684909 U 12/2010
(Continued)

OTHER PUBLICATIONS

German Examination Report dated Jul. 15, 2019 from corresponding German Patent Application No. 102016221675.9.
(Continued)

*Primary Examiner* — Kevin P Kerns
(74) *Attorney, Agent, or Firm* — Dickinson Wright PLLC

(57) ABSTRACT

A device (10) for producing die-cast components with a die-casting mold (12) and a discharge device which is provided for controlled evacuation of a mold cavity and which includes at least one vacuum unit (18) and at least one suction line (20) which connects the die-casting mold. The suction line (20) terminates at a mold vacuum valve (21) in the mold cavity. The device is connected to a central control system (1). A filter module (2) is inserted in the at least one suction line (20) which contains at least one filter, a moisture sensor, and a pressure sensor.

6 Claims, 4 Drawing Sheets

(56) References Cited

U.S. PATENT DOCUMENTS

2006/0042773 A1 3/2006 Eisen

FOREIGN PATENT DOCUMENTS

Figure 1:
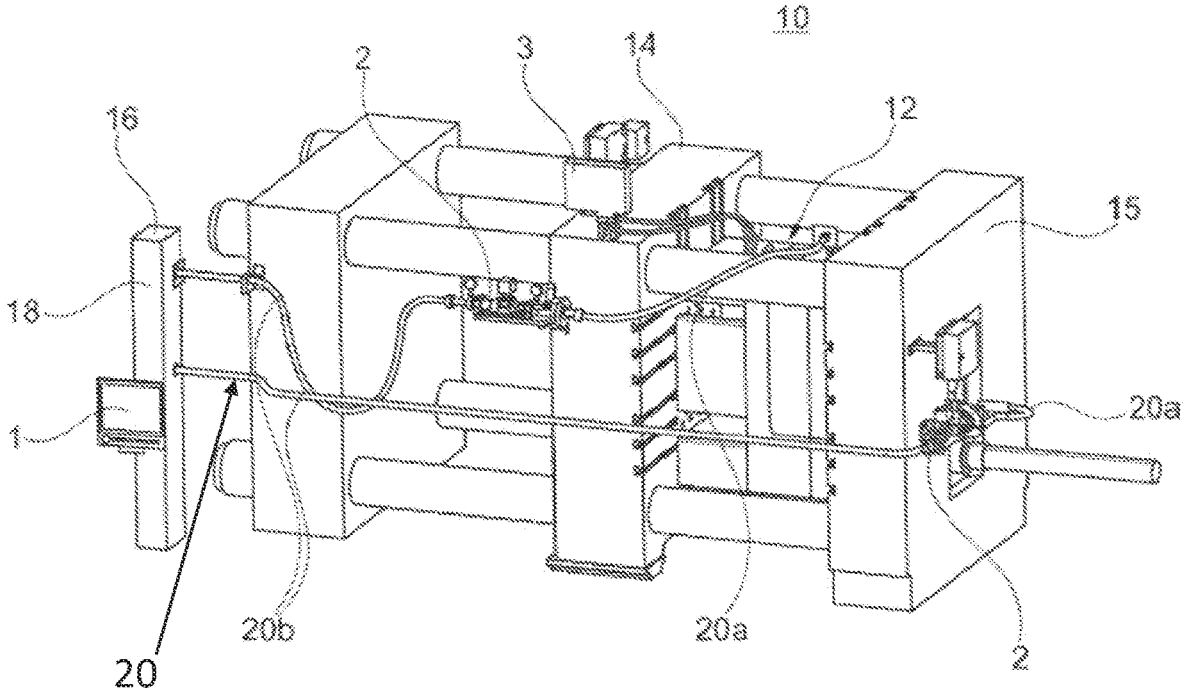

| | | | |
|---|---|---|---|
| CN | 202639273 | U | 1/2013 |
| CN | 204353444 | U | 5/2015 |
| CN | 204524225 | U | 8/2015 |
| CN | 104972079 | A | 10/2015 |
| CN | 105458212 | A | 4/2016 |
| DE | 1161293 | B | 1/1964 |
| DE | 2710316 | A1 | 9/1977 |
| DE | 3340417 | A1 | 5/1985 |
| DE | 3841587 | A1 | 7/1989 |
| DE | 4313800 | A1 | 10/1993 |
| DE | 19611817 | A1 | 10/1997 |
| DE | 19628870 | A1 | 1/1998 |
| DE | 10022560 | A1 | 11/2001 |
| DE | 202004017551 | U1 | 2/2005 |
| DE | 202009013507 | U1 | 2/2010 |
| DE | 102011089480 | A1 | 6/2013 |
| DE | 102012008453 | A1 | 10/2013 |
| DE | 102012220513 | A1 | 6/2014 |
| DE | 112013006075 | T5 | 8/2015 |
| DE | 102015004029 | A1 | 10/2015 |
| EP | 0600324 | A1 | 6/1994 |
| EP | 0819487 | B1 | 4/2002 |
| EP | 0798027 | B1 | 6/2002 |
| EP | 1017931 | B1 | 12/2003 |
| EP | 1057559 | B1 | 10/2004 |
| EP | 1516687 | A1 | 3/2005 |
| JP | H1157968 | A | 3/1999 |
| JP | 2007222896 | A | 9/2007 |
| WO | WO9117010 | A1 | 11/1991 |

OTHER PUBLICATIONS

German Examination Report dated Jul. 15, 2019 from corresponding German Patent Application No. 102016221674.0.

German Examination Report dated Jul. 15, 2019 from corresponding German Patent Application No. 102016221678.3.

International Search Report and Written Opinion dated Jun. 18, 2018 from corresponding International Patent Application No. PCT/EP2017/076860 with English translation of International Search Report.

German Search Report dated Aug. 7, 2017 from corresponding German Patent Application No. 102016221675.9.

German Search Report dated Aug. 8, 2017 from corresponding German Patent Application No. 102016221674.0.

German Search Report dated Aug. 8, 2017 from corresponding German Patent Application No. 102016221678.3.

DEVICE, CONTROL SYSTEM AND FILTER MODULE FOR PRODUCING DIE-CAST PARTS, AND METHOD THEREFOR

CROSS-REFERENCE TO RELATED APPLICATIONS

This application is a continuation of International Application No. PCT/EP2017/076860, filed Oct. 20, 2017, which claims priority to German Application No. DE 10 2016 221 678.3 filed Nov. 4, 2016, German Application No. DE 10 2016 221 674.0 filed Nov. 4, 2016 and German Application No. DE 10 2016 221 675.9 filed Nov. 4, 2016. The entire disclosures of each of the above applications are incorporated herein by reference.

FIELD OF THE INVENTION

The present invention relates to a device for producing die-cast components with a die-casting mold and a discharge device which is provided for controlled evacuation of a mold cavity and which comprises a vacuum unit and a suction line which connects the vacuum unit and the die-casting mold. The invention further relates to a control system and a filter module for the device for producing die-cast components and a method for producing die-cast components.

BACKGROUND OF THE INVENTION

This section provides background information related to the present disclosure which is not necessarily prior art.

A generic device for producing die-cast components is known from DE 30 02 886 C2. In this as in other known die-casting machines with discharge devices for ventilating the casting molds, the last mold filling is carried out with liquid metal in conjunction with the evacuation of the mold within a few milliseconds. The objective in this instance is to achieve the highest possible vacuum in the mold cavity of the casting mold in order to achieve the highest possible quality of the cast component.

EP 0 600 324 A1 describes a method for producing a vacuum in a vacuum die-casting machine. in which the vacuum which is intended to be applied to the die-casting mold can be subjected to a control operation during the casting process. In this instance, the vacuum applied via a vacuum valve is controlled by means of a switching valve in terms of the pressure path thereof in such a manner that the pressure in the mold cavity, in the casting chamber and in the suction pipe is controlled per time unit in accordance with a specific adjustable function. The reduced pressure is detected by means of a vacuum measuring probe which measures the pressure in a vacuum connection line.

In a die-casting method, however, it is also necessary to use separation and lubrication media. These additives are primarily intended to produce a separation layer between the liquid metal and the contour of the casting mold so that an adhesion of the metal to the casting mold is prevented. This occurs in particular with aluminum casting as a result of the high affinity of the aluminum for chilling the casting mold. Generally, for the production of the blocking layer mentioned, water-miscible separation media are used. As a result of these separation media, a cooling or temperature control of the die-casting mold is further achieved.

The disadvantage with these devices or methods is, however, that after removing the cast component a new application of separation medium is required and, when the casting mold is blown dry, residual moisture remains in the mold cavity. As a result of the subsequent evacuation operation of the casting mold, although this residual moisture can be removed by a given percentage from the mold cavity together with other gases which occur during the casting operation, a degree of residual moisture always remains in the casting mold. However, this residual moisture remaining in the die-casting mold reacts in a subsequent casting operation with the liquid metal again with gas being formed. The gas then becomes evident in the form of porosity or cavities in the completed cast component. There is thereby produced a considerable quality reduction of the completed cast component.

EP0819487B1 discloses a device for producing die-cast components which has two valves which are arranged in a suction line. The two valves which are connected in parallel produce or interrupt the connection between a vacuum tank and a die-casting mold. As a result of the closure of the two valves, a so-called reference space is produced in the suction line. This reference space reflects the state which existed when the last evacuation process of the die-casting mold was ended. It is thereby possible in a simple manner to determine extremely different parameters which are decisive for the quality of the die-casting, in particular the residual moisture content in the system, and to control the device accordingly. DE10022560 A1 discloses a die-casting arrangement which has a pressure monitoring system on the ventilation channel which has a valve and a filter.

All the components of the system, above all valves and sensors, are subjected to significant wear and are maintenance-intensive.

DE4313800 A1 discloses a method for controlling a die-casting device with controlled evacuation. This control system is central, but has no modules which are provided for different tasks.

DE 20 2004 017 551 U1 discloses a control system for hydraulic and pneumatic components.

SUMMARY

This section provides a general summary of the disclosure, and is not a comprehensive disclosure of its full scope or all of its features.

An object of the present invention is to provide an improved device, an improved control system, a filter module and an improved method which protects the components and/or makes them accessible for rapid maintenance.

The object is achieved with a device for producing die-cast components with a die-casting mold and a discharge device which is provided for controlled evacuation of a mold cavity and which comprises at least one vacuum unit and at least one suction line which connects the die-casting mold, wherein the suction line terminates at a mold vacuum valve in the mold cavity, wherein the device is connected to a central control system, wherein there is inserted in the at least one suction line a filter module which contains at least one filter, a moisture sensor, a pressure sensor.

As a result of the use of a filter module which integrates several functions in one component, the device for producing die-cast components can be constructed in such a manner that a simple maintenance is possible. In this case, the filter module integrates several functions, such as the filter function and measurement functions, in one component so that the device can be readily equipped with the filter module.

It is advantageous for the filter module to be installed in such a manner that the connection piece between the filter and mold vacuum valve, the line, is shorter than the discharge line between the filter and vacuum pump. The filter module can thereby be fitted as close as possible to the actual mold cavity, which enables an optimization of the measurements of the parameters in the mold cavity.

The solution according to the invention can advantageously be used in devices in which the die-casting mold comprises a movable mold half and a fixedly arranged mold half.

Depending on the embodiment of the die-casting machine, it is advantageous for the suction line to be secured to the movable mold half or the fixed mold half.

The device according to the invention has the advantage that the mold vacuum valves are different types of valves. Consequently, it is possible to use valves on quite different die-casting machines, which also use different valve types. A replacement of the valve types, for example, of a pneumatic valve, with a hydraulic valve is possible in a simple manner.

Advantageously, the control system is configured to control at least one type of mold vacuum valves.

In this instance, the control for a device for producing die-cast components is configured with a die-casting mold and a discharge device which is provided for controlled evacuation of a mold cavity, wherein the device is connected to a central control system, wherein the control system has a control unit in which at least one module is connected to the device for producing die-cast components and additional modules are connected to at least one hydraulic unit and/or pneumatic unit for controlling valves.

The control system is in this instance particularly flexible and can be adapted to the requirements of different installations.

It is advantageous for the at least one module for the hydraulic unit to be able to be operated in parallel with the at least one module for the pneumatic unit. This enables the use of the control system in mixed installations in which different components from the hydraulic or pneumatic system are used. The control unit has components for controlling valves in the casting tool for the use of vacuum-supported die-casting, wherein the type of valves, that is to say, mechanical, hydraulic, pneumatic, can be exchanged. Consequently, with different modules, the mixed operation of the device can be carried out.

It is advantageous for the components for controlling valves to comprise software components. The control unit has inputs for all the measurement data collected in the device.

An object of the present invention is to provide an improved filter module which protects the components and/or makes them accessible for rapid maintenance. The object is also achieved with a filter module for a device for producing cast components with a casting mold, wherein the filter module contains at least one filter housing comprising a base and cover, wherein the base and cover are tightly connected to each other by means of at least two knurled screws and form a structural space for a filter insert.

As a result of the construction with knurled screws, the filter housing can be maintained in a simple manner. No tool is required for opening and closing and the production process is thereby interrupted only briefly.

It is advantageous for the base and cover to be tightly connected to each other by means of an O-ring, wherein the O-ring seal constitutes a reliable seal which also provides reliable sealing in the case of frequent maintenance.

It is further advantageous for the filter insert to be formed by a metal cylinder which is delimited at the end faces by perforated plates so that the entire filter insert can be removed in a simple manner from the filter housing.

The filter insert contains at least one fine filter and one coarse filter in the metal cylinder so that residues from the casting process can be separated in the filters.

In this instance, the fine filter and coarse filter are secured in the metal cylinder by means of a securing ring.

It is advantageous for the filter module to contain at least one moisture sensor and/or at least one pressure sensor.

The filter module integrates in this instance several functions, such as the filter function and measurement function, in one component so that the device can be readily equipped with the filter module.

Advantageously, the filter module is arranged between the casting tool and measurement device.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Other details, features and advantages of the invention will be appreciated from the following description of an embodiment which is illustrated in the drawings.

Figure 2:
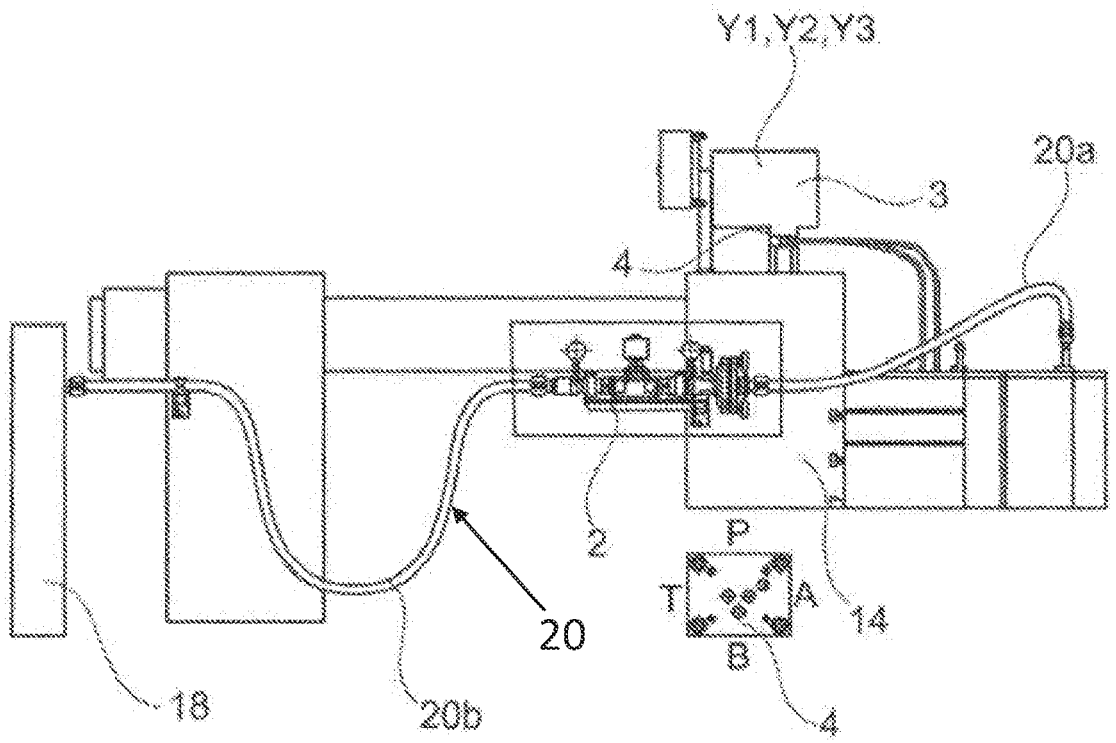
Figure 3:
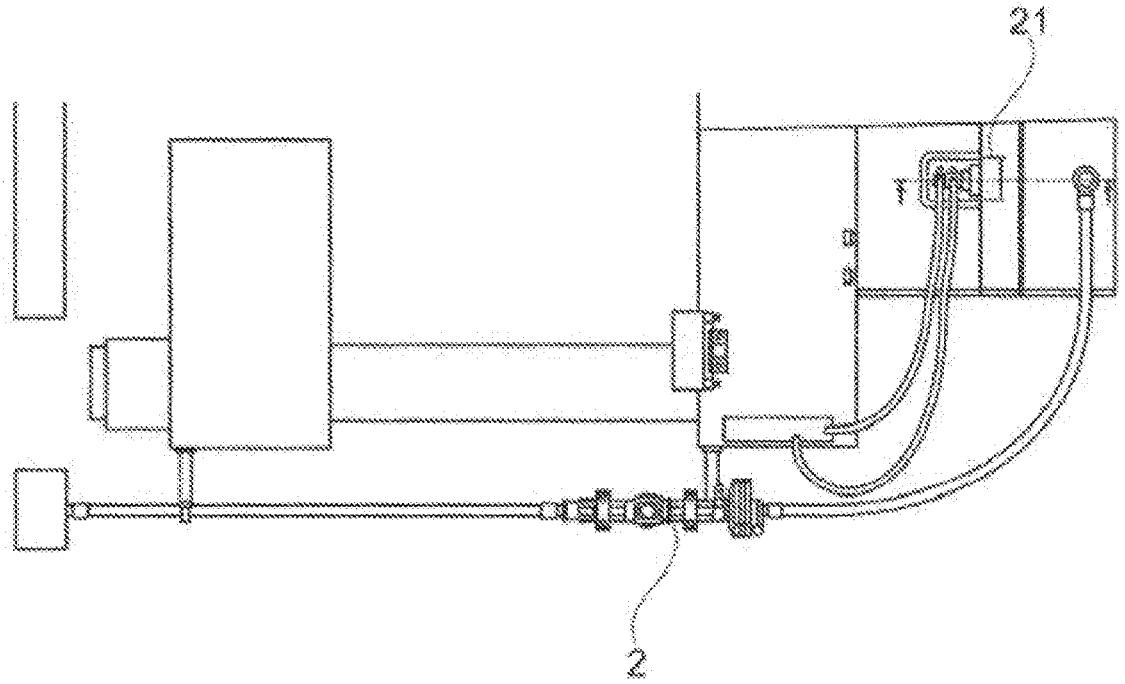
Figure 4:
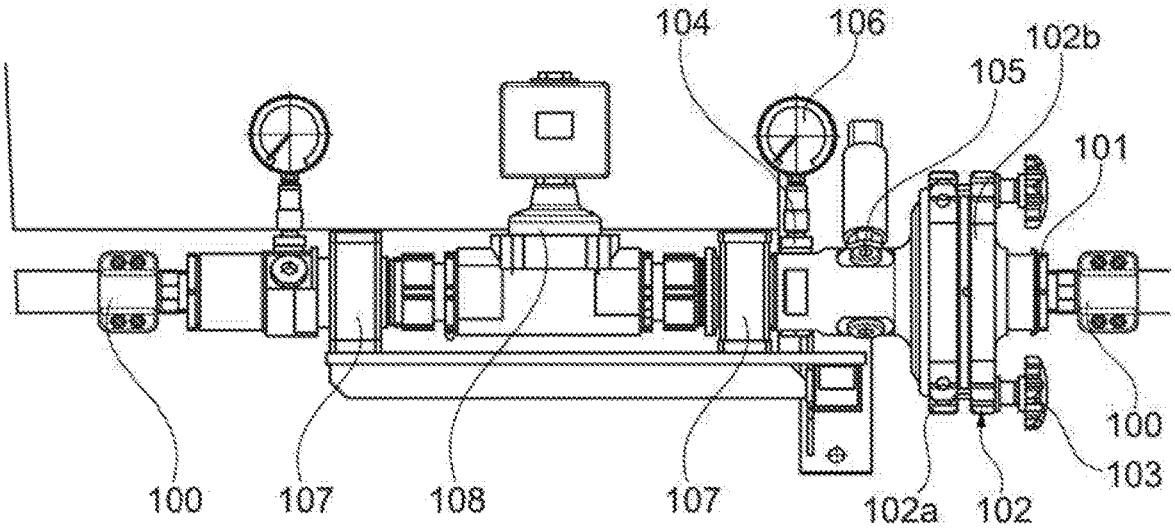
Figure 5:
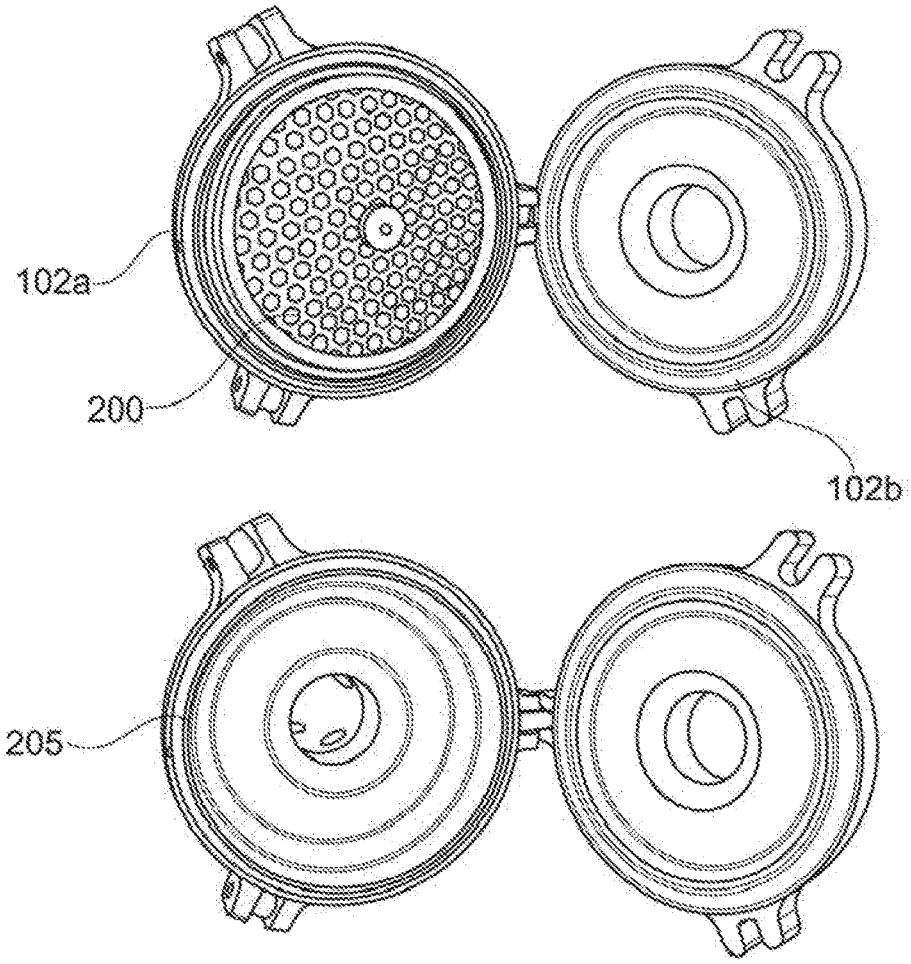
Figure 6:
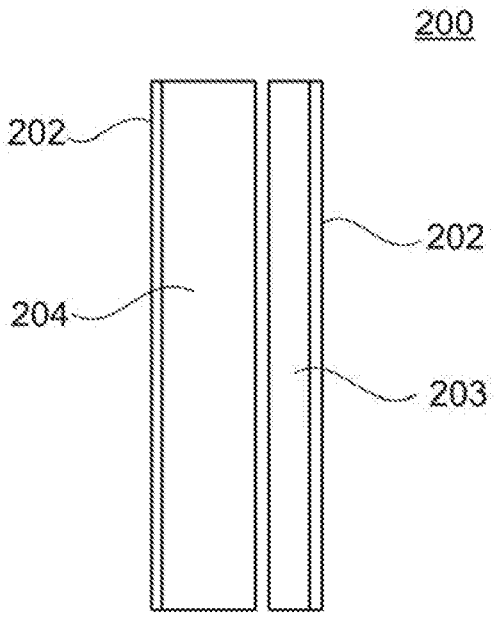
Figure 7:
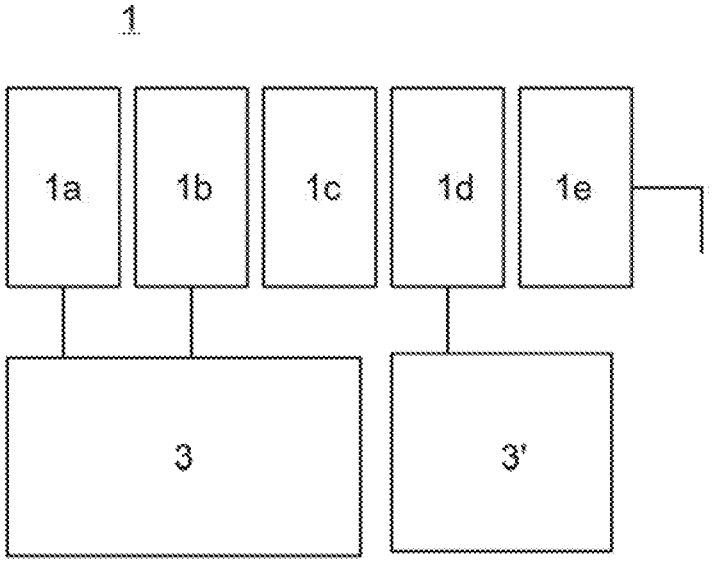

In the drawings:

FIG. 1 is a three-dimensional illustration of the device,

FIG. 2 is a schematic side view of the device according to the invention for producing die-cast components, FIG. 3 is a schematic plan view of the device according to the invention for producing die-cast components, FIG. 4 is a cross-section through a filter module, FIG. 5 is a schematic illustration of a filter, FIG. 6 is a cross-section through a filter insert, FIG. 7 is a schematic depiction of a control unit.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

A device 10 schematically illustrated in FIG. 1 for producing die-cast components substantially comprises a die-casting mold 12 and a discharge device 16. The die-casting mold 12 comprises in this example a movable mold half 14 and a fixed mold half 15. The discharge device 16 comprises in particular a suction line 20 and a vacuum pump 18 which is connected thereto. At the end of the suction line opposite the vacuum pump 18, it is connected to the movable mold half 14 and/or to the fixed mold half 15 of the die-casting mold 12. In the embodiment, 2 suction lines 20 are connected to the vacuum pump 18. The suction lines terminate in each case at the mold halves 14 and 15.

Between the die-casting mold 12 or between the mold halves and the vacuum pump 18, filter modules 2 are arranged in the suction line. The mold vacuum valve is not illustrated in FIG. 1, it is in the die-casting mold close to the connection of the suction line 20. The filters are arranged in the suction line and divide the suction line 20 into a first portion, the line 20*a*, and a second portion, the discharge line 20*b*. A control unit 3 which in this example is connected by means of hydraulic connections to the mold vacuum valve is fitted to the die-casting machine. A control system 1 is in this instance indicated only by a screen.

In FIG. 2, the device is illustrated as a side view and in FIG. 3 as a plan view, wherein the mold vacuum valve 21 is illustrated.

The suction line 20 contains the following components: lines 20*a* from the mold vacuum valve 21 to the main valve, a filter module 2 and a discharge line 20*b* between the filter module 2 and vacuum pump 18.

The suction line or the portion of the line 20*a* begins close to or in the mold vacuum valve 21.

The suction line comprises a particular heat-resistant reduced pressure hose and continues to the filter module 2, through the filter module 2 via a reduced pressure hose to a manual valve which is not illustrated and the die-casting machine. From there, the line leads into a vacuum line system and terminates at the vacuum pump station.

The filter module 2 is constructed as a compact component and has different tasks.

The filter module is in this instance illustrated in an enlarged state in FIG. 4.

At the input side and at the output side, the filter module has a connection which can be connected by means of screw connections 100 to 1 or 2 inch connection pieces. Via these screw connections, the compact filter module 2 can be connected to the pipework of the vacuum system.

Via a reduction double nipple 101, a filter housing 102 is connected. In the filter housing it is possible to see knurled screws 103 which connect the filter housing, which comprise a base 102*a* and a cover 102*b*.

There is connected to the filter a pressure sensor 104 which is connected by means of a reduction 105.

A pressure gauge 106 is fitted downstream. Via clamps 107 and screw connections a 2/2-way valve 108, that is to say, a valve with two controlled connections and two switching positions, is arranged in the filter module. This valve acts as a main valve.

In the 2/2-way valve, the residual moisture measurement member which, as in the prior art, protrudes into a reference space is accommodated.

The reference space reflects the ambient parameters of the state which existed when the die-casting operation was completed and the evacuation of the die-casting mold 12 was completed.

All the sensors, the pressure sensors and the residual moisture sensors, are connected directly or indirectly to the control unit 1. The valves are also connected to this control unit 1, wherein the control unit controls the entire casting process with all the components in accordance with the established measurement values.

The filter used in the filter module itself comprises a filter housing 102, which comprises a base 102*a* and a cover 102*b*. The two components are in this instance connected to the knurled screws 103 so that the housing components can be separated in a simple manner. In order to seal the housing components 102*a* and 102*b*, an O-ring 205 is in abutment with a planar peripheral face of the housing components which in order to guide the O-ring has a groove connected three knurled screws which are fitted in an equidistant manner with respect to each other. Naturally, the person skilled in the art may also use any other number of knurled screws. Using the knurled screws simplifies the maintenance of the filter since the filter can be opened by a person without using a tool.

If the two components, as shown in FIG. 5, are separated, a filter insert 200 can be seen at the inner side. The filter insert comprises, as shown in cross-section in FIG. 6, a metal cylinder which is terminated by two perforated plates 202. Between the two perforated plates 202, a fine filter 203 and a coarse filter 204 are fitted. A securing ring is used to fix the fine filter and the coarse filter in the metal cylinder.

The coarse filter comprises steel filter wool and can be cleaned by knocking out the dirt from the casting process.

The fine filter is cleaned with benzene or a suitable cleaning agent. It is important that the coarse side of the filter faces with the steel wool filter in the direction of the mold vacuum valve and the fine filter faces in the direction of the solenoid valve. The replacement intervals of the filter insert are dependent on the extent of the dirt particles which have been deposited during a production layer. In the event of significant use, hourly filter insert changes are completely feasible.

The filter combination of a coarse filter and a fine filter minimizes the input of dirt from the casting process in the direction of the sensors.

The filter housing 102 is provided with a pressure measuring device which indicates the actual value of the vacuum during the emptying phase, the end value represents in this instance the vacuum level in the cavity.

The filter housing 102 has in an integrated manner a ½ inch opening for connecting the sensor 104 for measuring and recording the pressure.

The analogue output signal of the sensor is transmitted to the control unit 1. The filter module having a solenoid valve and additional components functions as a result of the use of the filters in a significantly more wear-free manner than without any filter since they can be replaced and/or cleaned in a simple manner.

The machine according to the invention for producing die-cast components further requires at least one positive-locking valve for the discharge device close to the casting mold.

With die-casting machines with discharge devices for ventilating the molds, the final mold filling with liquid metal is carried out in conjunction with the evacuation of the mold within a few milliseconds. In order to achieve the highest possible vacuum, it is accordingly advantageous to close the suction channel which is used for evacuation and which is connected to the mold as late as possible, that is to say, shortly before the liquid metal can spray into the suction system. Suitable valves are described, for example, as hydraulic valves in DE 3002886 A1.

There are alternative valve types, such as, for example, pneumatic valves or washboard valves, which are used in order to rapidly reduce the pressure in the casting mold.

Pneumatic valves have system-related problems. In comparison with hydraulic drives, the pneumatic forces and torques are significantly lower and pneumatic cylinder movements are always carried out point-to-point. The end position is in each case defined by a fixed stop. Pneumatic valves must thereby be fitted very close to the casting mold, which increases the wear of these components.

Washboard valves are referred to as an "open ventilation system". The ventilation power of the valve is determined primarily by the gap size between the valve halves and the valve width. These valves are often used in combination with a path-controlled or time-controlled valve.

The type of the valves, as mold vacuum valves, does not limit the power of the device according to the invention. Instead it is the case that different valve types can be used. Furthermore, a die-casting machine does not necessarily have to be provided with the valve type, but instead combinations of different valves types are also permitted.

The device according to the invention has a control unit 1, which processes all the measurement values of the device and by means of which all hydraulic, pneumatic systems are controlled.

A hydraulic control unit 3 controls with a hydraulic valve the pressure cylinder from the insertion of the insertion piece of the valve actuation to opening and closing the mold valve by means of control bolts.

This exemplary hydraulic control unit 3 is screwed to a distributor plate 4. On the distributor plate there are the following connections:

P=Operating pressure of the die-casting machine (min. 120-160 bar);

T=Tank pipe (0 bar);

A=Disengaging the cylinder=open valve (at 120-160 bar);

B=Engaging the cylinder=closed valve. (with a storage pressure of approximately 95-100 bar)

A control valve Y1, a directional spool valve Y2 having a cartridge non-return valve in the P-pipe of Y2, a directional spool valve Y3, a pressure reduction valve 95-100 bar), a diaphragm accumulator (Po–=60 bar nitrogen) and a cartridge non-return valve in the P-pipe of the base plate are integrated in a control unit 3 in a single housing.

The integrated directional spool valve Y3 acts as a safety valve for automatically discharging the storage pressure when the installation is switched off. The diaphragm accumulator is provided for a constant pressure for moving the hydraulic cylinder and consequently the insertion for opening/closing the mold vacuum valve.

The device for producing die-cast components additionally has a modular control unit. The control system 1 has inputs for the detection of all the measurement data collected on the device and control outputs for suction paths and sub-units, such as the hydraulic control system 3 and the pneumatic control system 3'. The control system is constructed in such a manner that it is configured to be compatible with different structural elements and valve types. The control system may control in a parallel manner different types of valves, such as a hydraulic and a pneumatic valve. A replacement of a valve type with another type is thus simple since only the associated control module is activated and adapted.

With the control system according to the invention, a plurality of mold evacuation lines and rapid vacuum lines can be controlled.

The control system is implemented in a switch cabinet with PLC control. The control enables safe interrogation based on the piston position of the mold valve in order to detect the closure state of the valve.

The closure position may, however, also be adjustable and variable without position determination by means of measurement in the closure movement and is thus controlled by the control system by means of fixedly predetermined time periods.

In FIG. 7, the control system is illustrated schematically. The actual software is shown in a modular manner as software components 1*a*, 1*b*, 1*c*, 1*d*, 1*e*. The software is suitable for operating individual modules together while undesired modules remain inactive.

The software modules 1*a* . . . 1*e* control in this example by means of data connections two control units 3 and 3'. In this instance, control units for valves of either the same or different type are involved. The control unit 3 may thus be a control unit for hydraulic mold vacuum valves, the control unit 3' in contrast may be a control unit for pneumatic valves. The control system further optionally controls the vacuum units and the actual die-casting machine.

The method for producing die-casting components is characterized by the following method steps:

a) evacuating a die-casting mold, b) filling the die-casting mold with casting material, c) removing the die-casting component, e) measuring ambient parameters in the filter module, and f) according to the result of these measurements, a device for producing die-cast components is controlled.

It is thereby ensured that the method is controlled in accordance with the actual ambient parameters in the die-casting mold and can be standardized to corresponding optimized ambient parameters. It is thus possible to adjust the casting process in such a manner that the measured residual moisture reaches a minimum which is typical in accordance with the die-casting mold and component and the method moves into a stable state.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

LIST OF REFERENCE NUMERALS

1 Control unit
1*a*,1*b*,1*c*,1*d*,1*e* Control modules
2 Filter module
3 Control module
4 Distributor plate
10 Device
12 Die-casting mold
16 Discharge device
14 Movable mold half
15 Fixed mold half
18 Vacuum pump
20 Suction line
20*a* Line
20*b* Discharge line
21 Mold vacuum valve
100 Screw connection
101 Reduction double nipple
102 Filter housing
102 *a, b* Base and cover
103 Knurled screw
104 Pressure sensor
105 Reduction
106 Pressure gauge
107 Clamp
108 2/2-way valve
200 Filter insert

202 Perforated plates
203 Fine filter
204 Coarse filter
205 O-ring

The invention claimed is:

1. A control system for a device for producing die-cast components with a die-casting mold and a discharge device which is provided for controlled evacuation of a mold cavity and which comprises at least one vacuum unit and at least one suction line connected to the die-casting mold, wherein the at least one suction line terminates at at least one mold vacuum valve in the mold cavity, wherein the device is connected to a central control system and wherein a filter module is inserted in the at least one suction line, the filter module contains at least one filter, a moisture sensor, and a pressure sensor, wherein the filter module is installed in such a manner that a connection line of the suction line between the at least one filter and mold vacuum valve is shorter than a discharge line of the suction line between the at least one filter and vacuum pump;

wherein a control unit includes at least one hydraulic unit for controlling at least one hydraulic valve and at least one pneumatic unit for controlling at least one pneumatic valve, wherein the mold vacuum valve is at least one of an interchangeable hydraulic valve and an interchangeable pneumatic valve, and wherein the mold vacuum valve is connectable to the hydraulic unit and the pneumatic unit.

2. The control system as claimed in claim 1, wherein the at least one hydraulic unit and the at least one pneumatic unit are operated in parallel with one another.

3. The control system as claimed in claim 1, wherein the control unit for controlling valves comprises software components.

4. The control system as claimed in claim 1, wherein the control unit contains inputs for all measurement data collected on the device.

5. A device for producing die-cast components, comprising:

a die-casting mold defining a mold cavity;

a discharge device for controlled evacuation of the mold cavity;

the discharge device including at least one vacuum unit and at least one suction line connected to the die-casting mold, wherein the at least one suction line terminates at a mold vacuum valve in the mold cavity;

a filter module located in the at least suction line, the filter module including at least one filter, a moisture sensor and a pressure sensor; and a control unit including a hydraulic unit configured to control at least one hydraulic valve, and a pneumatic unit configured to control at least one pneumatic valve;

wherein the mold vacuum valve is at least one of an interchangeable hydraulic valve and an interchangeable pneumatic valve, and wherein the mold vacuum valve is connectable to the hydraulic unit and the pneumatic unit.

6. The device for producing die-cast components as claimed in claim 5, wherein the hydraulic unit and the pneumatic unit are configured to be operated in parallel with one another.

* * * * *